US011537074B2

(12) United States Patent
Tanaka et al.

(10) Patent No.: US 11,537,074 B2
(45) Date of Patent: Dec. 27, 2022

(54) FIXING DEVICE

(71) Applicant: BROTHER KOGYO KABUSHIKI KAISHA, Nagoya (JP)

(72) Inventors: Tokifumi Tanaka, Komaki (JP); Hideki Kanada, Toyohashi (JP); Mingguang Zhang, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/539,371

(22) Filed: Dec. 1, 2021

(65) Prior Publication Data

US 2022/0179345 A1 Jun. 9, 2022

(30) Foreign Application Priority Data

Dec. 4, 2020 (JP) ..... JP2020-202246
Dec. 4, 2020 (JP) ..... JP2020-202247

(51) Int. Cl.
*G03G 15/20* (2006.01)

(52) U.S. Cl.
CPC ..... *G03G 15/2057* (2013.01); *G03G 15/206* (2013.01); *G03G 15/2025* (2013.01)

(58) Field of Classification Search
CPC ..... G03G 15/2057; G03G 15/2025; G03G 15/2053; G03G 15/206
See application file for complete search history.

(56) References Cited

U.S. PATENT DOCUMENTS

2011/0058870 A1* 3/2011 Murakami ..... B65H 5/062 399/361
2014/0086651 A1* 3/2014 Otsu ..... G03G 15/2025 428/116
2014/0205332 A1* 7/2014 Otsu ..... G03G 15/2053 399/329
2019/0243293 A1* 8/2019 Tanaka ..... G03G 15/2053
2020/0209788 A1* 7/2020 Mochizuki ..... G03G 15/2025

FOREIGN PATENT DOCUMENTS

JP 2004-029607 * 1/2004
JP 2004-037764 * 2/2004
JP 2004-198655 * 7/2004
JP 2005-317519 * 11/2005
JP 2007-187889 * 7/2007
JP 2009-014893 * 1/2009
JP 2013-210608 * 10/2013

* cited by examiner

*Primary Examiner* — Sandra Brase
(74) *Attorney, Agent, or Firm* — Merchant & Gould P.C.

(57) ABSTRACT

A fixing device includes a rotating body, an endless belt, a base material of the endless belt being made of a heat-resistant resin having a glass transition temperature of 140° C. or more, a heater configured to heat at least one of the rotating body and the endless belt, a sliding sheet contacting an inner circumferential surface of the endless belt, a base material of the sliding sheet being made of a heat-resistant resin having a glass transition temperature of 140° C. or more, a pressure pad, the endless belt and the sliding sheet being interposed between the pressure pad and the rotating body, and grease provided between the endless belt and the sliding sheet. The grease includes a base oil made of a fluorine oil and a thickener made of a solid lubricant containing fluorine. The consistency of the grease is 330 to 385 at 25° C.

20 Claims, 5 Drawing Sheets

FIXING DEVICE

CROSS REFERENCE TO RELATED APPLICATION

The present application claims priority from Japanese Patent Application Nos. 2020-202246 and 2020-202247, which were filed on Dec. 4, 2020, the disclosures of which are herein incorporated by reference in their entireties.

BACKGROUND

The following disclosure relates to a fixing device including an endless belt.

There has been known a fixing device using a pressure pad and having a sliding sheet located between an endless belt and the pressure pad. Heat-resistant resin is used for the endless belt and the sliding sheet, and grease is used for reducing friction between the endless belt and the sliding sheet.

SUMMARY

When the endless belt and the sliding sheet slide at a high temperature in the fixing device, there is a problem that adhesion occurs between heat-resistant resins of the endless belt and the sliding sheet to increase a wear amount.

An aspect of the disclosure relates to a fixing device capable of suppressing wear between the endless belt and the sliding sheet.

In one aspect of the disclosure, a fixing device includes a rotating body, an endless belt contacting an outer circumferential surface of the rotating body, a base material of the endless belt being made of a heat-resistant resin having a glass transition temperature of 140° C. or more, a heater configured to heat at least one of the rotating body and the endless belt, a sliding sheet contacting an inner circumferential surface of the endless belt, a base material of the sliding sheet being made of a heat-resistant resin having a glass transition temperature of 140° C. or more, a pressure pad, the endless belt and the sliding sheet being interposed between the pressure pad and the rotating body, and grease provided between the endless belt and the sliding sheet. The grease includes a base oil made of a fluorine oil and a thickener made of a solid lubricant containing fluorine. The consistency of the grease is 330 to 385 at 25° C.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which.

EMBODIMENTS

Figure 1:
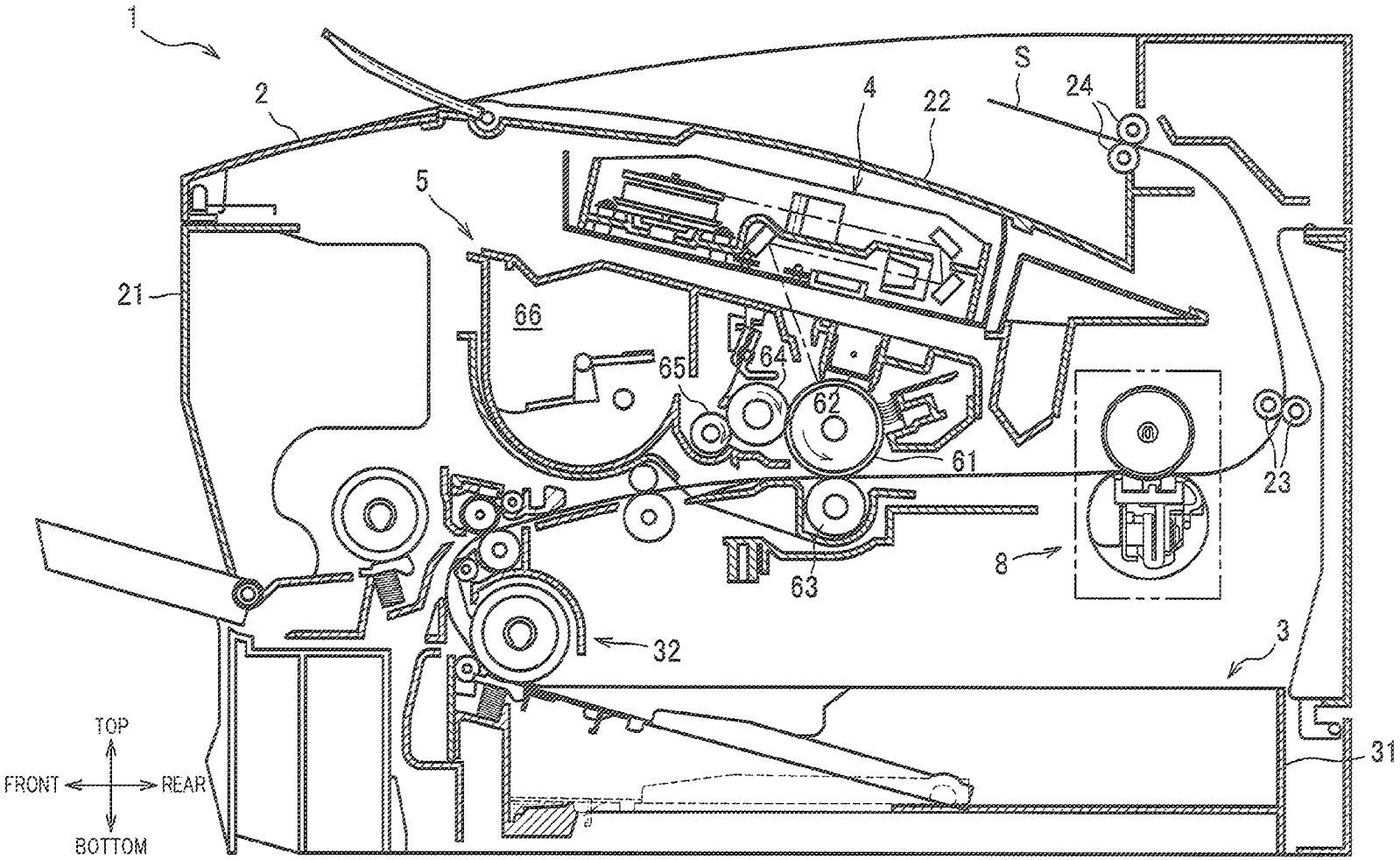
FIG. 1 is a cross-sectional view illustrating a laser printer according to an embodiment of the present disclosure.

Hereinafter, an embodiment of the present disclosure will be explained in detail suitably with reference to the drawings. As illustrated in FIG. 1, a fixing device 8 according to the embodiment is used in an image forming apparatus 1 such as a laser printer. The image forming apparatus 1 includes a body housing 2, a sheet supplier 3, an exposing device 4, a developer image forming unit 5, and the fixing device 8.

The sheet supplier 3 is provided at a lower part in the body housing 2, and includes a sheet tray 31 accommodating a sheet S such as a paper, and a sheet supply mechanism 32. The sheet S in the sheet tray 31 is supplied to the developer image forming unit 5 by the sheet supply mechanism 32.

The exposing device 4 is disposed at an upper part in the body housing 2, and includes a not-illustrated light source device, a polygon mirror, a lens, a reflection mirror, and the like which are illustrated with no symbols. The exposing device 4 exposes a surface of a photoconductive drum 61 by scanning the surface of the photoconductive drum 61 at high speed with a light beam (refer to a long and short dashed line) generated based on image data, which is emitted from the light source device.

The developer image forming unit 5 is disposed below the exposing device 4. The developer image forming unit 5 is configured as a process cartridge, which is mountable/detachable on/from the body housing 2 from an opening formed when a front cover 21 provided in the front of the body housing 2 is opened. The developer image forming unit 5 includes the photoconductive drum 61, a charging unit 62, a transfer roller 63, a developing roller 64, a supply roller 65, and a developer container 66 containing a developer made of dry toner.

The developer image forming unit 5 charges the surface of the photoconductive drum 61 uniformly by the charging unit 62. After that, the surface of the photoconductive drum 61 is exposed with the light beam from the exposing device 4, and an electrostatic latent image based on image data is formed on the surface of the photoconductive drum 61. The developer image forming unit 5 supplies the developer in the developer container 66 to the developing roller 64 through the supply roller 65.

Then, the developer image forming unit 5 supplies the developer on the developing roller 64 to the electrostatic latent image formed on the photoconductive drum 61. Accordingly, the electrostatic latent image is visualized, and a developer image is formed on the photoconductive drum 61. After that, the developer image forming unit 5 conveys the sheet S supplied from the sheet supplier 3 between the photoconductive drum 61 and the transfer roller 63 to thereby transfer the developer image on the photoconductive drum 61 onto the sheet S.

The fixing device 8 is disposed behind the developer image forming unit 5. The details of the fixing device 8 will be described below. The fixing device 8 is configured to heat-fix the developer image on the sheet S by causing the sheet S onto which the developer image is transferred to pass through the fixing device 8. The image forming apparatus 1 discharges the sheet S to which the developer image is heat-fixed to an output tray 22 at an outside of the body housing 2 by a conveying roller 23 and an output roller 24.

Figure 2:
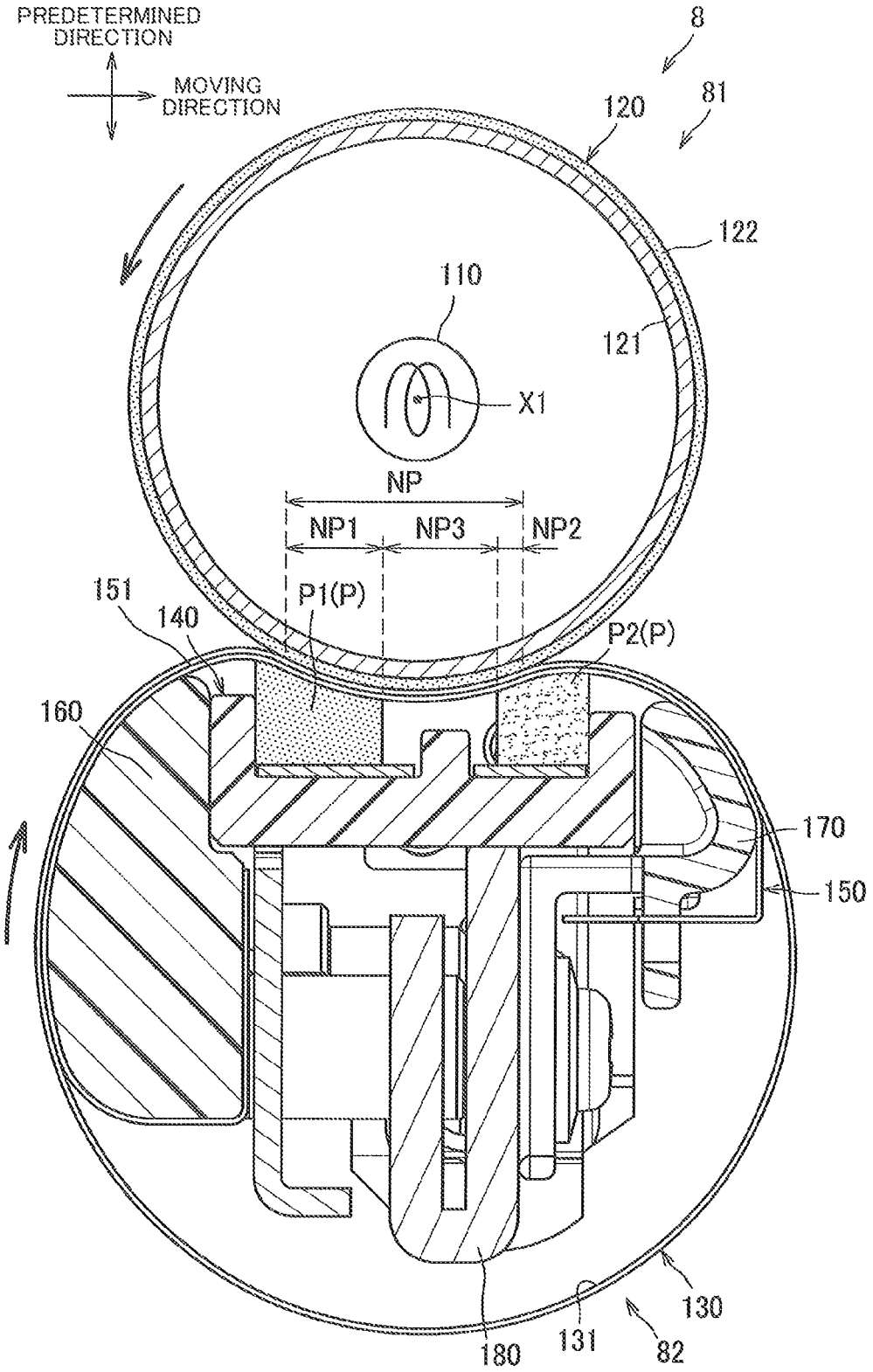
FIG. 2 is a cross-sectional view illustrating a fixing device.

As illustrated in FIG. 2, the fixing device 8 includes a heating unit 81 and a pressure unit 82. The pressure unit 82 is urged toward the heating unit 81 by a not-illustrated pressing mechanism. In the following description, a direction in which the pressure unit 82 is urged toward the heating unit 81 is called a "predetermined direction". In the embodiment, the predetermined direction is a direction orthogonal to a width direction and a moving direction to be described below, and the predetermined direction is the direction in which the heating unit 81 and the pressure unit 82 are opposed to each other.

The heating unit 81 includes a heater 110 and a rotating body 120. The pressure unit 82 includes an endless belt 130, a pressure pad P, a holder 140, a sliding sheet 150, an upstream belt guide 160, a downstream belt guide 170, a stay 180, and grease GR. In the following description, a width direction of the endless belt 130 is referred to merely as a "width direction". The width direction is a direction in which a rotation axis X1 of the rotating body 120 extends. The width direction is orthogonal to the predetermined direction.

The heater 110 heats at least one of the rotating body 120 and the endless belt 130. In the embodiment, the heater 110 is disposed inside the rotating body 120 and configured to heat the rotating body 120.

The rotating body 120 is a cylindrical roller, including a tube blank 121 and an elastic layer 122. The tube blank is a pipe made of metal. The elastic layer 122 is rotatable around the rotation axis X1. The rotating body 120 is driven to rotate by a not-illustrated motor provided in the image forming apparatus 1. The elastic layer 122 is provided on an outer circumference of the tube blank 121. In other words, the rotating body 120 has the elastic layer 122 on a circumferential surface thereof. The elastic layer 122 has elasticity.

The endless belt 130 is an endless-shaped belt made of metal or the like. The endless belt 130 has a width larger than a width of the sheet S with the maximum width conveyed in the image forming apparatus 1. The endless belt 130 is in contact with an outer circumferential surface of the rotating body 120. The endless belt 130 conveys the sheet S in a state in which the sheet S is nipped between the endless belt 130 and the rotating body 120. The endless belt 130 is driven to be rotated in a clockwise direction of FIG. 2 due to friction with respect to the rotating body 120 or the sheet S when the rotating body 120 rotates.

The pressure pad P is a member forming a nip portion NP by cooperating with the rotating body 120 to nip the endless belt 130, the sliding sheet 150, and the sheet S therebetween. In the following description, a moving direction of the endless belt 130 in the nip portion NP is referred to merely as a "moving direction". The moving direction in the nip portion NP is a direction along the outer circumferential surface of the rotating body 120 in the nip portion NP of the embodiment. This direction is along a direction almost orthogonal to the predetermined direction and the width direction in the nip portion NP; therefore, it is illustrated as the direction orthogonal to the predetermined direction and the width direction. The moving direction is the same direction as the conveying direction of the sheet S in the nip portion NP The pressure pad P includes a first pressure pad P1 and a second pressure pad P2. The second pressure pad P2 is located spaced apart from the first pressure pad P1 on a downstream side of the first pressure ad P1 in moving direction. The second pressure pad P2 has a higher durometer hardness than the first pressure pad P1.

The durometer hardness is specified in ISO7619-1. The durometer hardness is a value obtained from a pushing depth of a predetermined push needle at the time of pushing the push needle into a test piece under predetermined conditions. For example, in a case where a durometer hardness of the elastic layer 122 is 5, a durometer hardness of the first pressure pad P1 is preferably 6 to 10, and a durometer hardness of the second pressure pad P2 is preferably 70 to 90.

The first pressure pad P1 is a rectangular parallelepiped member. The first pressure pad P1 is made of rubber such as silicone rubber. The first pressure pad P1 has elasticity and can be elastically deformed. Since the first pressure pad P1 is thicker in thickness than the elastic layer 122, a deformation amount of the elastic layer 122 is smaller than a deformation amount of the first pressure pad P1 when the rotating body 120 and the first pressure pad P1 are pressed to each other. The first pressure pad P1 forms a first nip portion NP1 by cooperating with the rotating body 120 to nip the endless belt 130 therebetween.

The second pressure pad P2 is a rectangular parallelepiped member. The second pressure pad P2 is made of rubber such as silicone rubber. The second pressure pad P2 has elasticity and can be elastically deformed. The second pressure pad P2 has a higher durometer hardness than the elastic layer 122, but the second pressure pad P2 has a thicker than in thickness than the elastic layer 122; therefore, a deformation amount of the elastic layer 122 is smaller than the deformation amount of the second pressure pad P2 when the rotating body 120 and the second pressure pad P2 are pressed to each other. The second pressure pad P2 forms a second nip portion NP2 by cooperating with the rotating body 120 to nip the endless belt 130 therebetween.

There exists a third nip portion NP3 on which pressure from the pressure unit 82 does not directly act between the first nip portion NP1 and the second nip portion NP2 in the moving direction. The endless belt 130 and the rotating body are in contact with each other in the third nip portion NP3, however, a member configured to cooperate with the rotating body 120 to nip the endless belt 130 therebetween does not exist in the third nip portion NP3; therefore, pressure is hardly applied in the third nip portion NP3. Accordingly, the sheet S passes the third nip portion NP3 almost without being pressurized while being heated by the rotating body 120. In the embodiment, an area from an upstream end of the first nip portion NP1 to a downstream end of the second nip portion NP2, namely, the entire area where an outer circumferential surface of the belt 130 is in contact with the rotating body 120 is referred to as the nip portion NP. That is, the nip portion NP includes the portion where pressing forces from the first pressure pad P1 and the second pressure pad P2 are not applied.

A dimension of a range not pressed by any of the first pressure pad P1 and the second pressure pad P2 in the nip portion NP where the rotating body 120 is in contact with the endless belt 130, namely, the dimension of the third nip portion NP3 in the moving direction is 20 to 50% of a dimension of the entire range of the nip portion NP in the moving direction. A dimension of a range pressed by the second pressure pad P2, namely, the dimension of the second nip portion NP2 in the moving direction is 10 to 20% of the dimension of the entire range of the nip portion NP in the moving direction.

The holder 140 is a member holding the pressure pad P.

The sliding sheet 150 is disposed to be interposed between an inner circumferential surface 131 of the endless belt 130 and the pressure pad P. The sliding sheet 150 is in contact with the inner circumferential surface 131 of the endless belt 130. When the rotating body 120 rotates, the sliding sheet 150 is constantly in contact with the endless belt 130. On the other hand, since only about half area of the endless belt 130 is in contact with the sliding sheet 150 as illustrated in FIG. 2, each of a plurality of areas of the inner circumferential surface of the endless belt 130 repeats a state where each of the plurality of areas of the inner circumferential surface of the endless belt 130 is in contact with the sliding sheet 150 and a state where each of the plurality of areas of the inner circumferential surface of the endless belt 130 is not in contact with the sliding sheet 150 alternately when the rotating body 120 rotates.

The sliding sheet 150 is a sheet-like member. A base material of the sliding sheet 150 is made of a heat-resistant resin having a glass transition temperature of 140° C. or more. The sliding sheet 150 is made of polyimide in the embodiment. That is, a base material of the endless belt 130 and the base material of the sliding sheet 150 are both polyimide in the embodiment. The sliding sheet 150 in which various coatings are applied on the surface thereof can be adopted.

Figure 3:
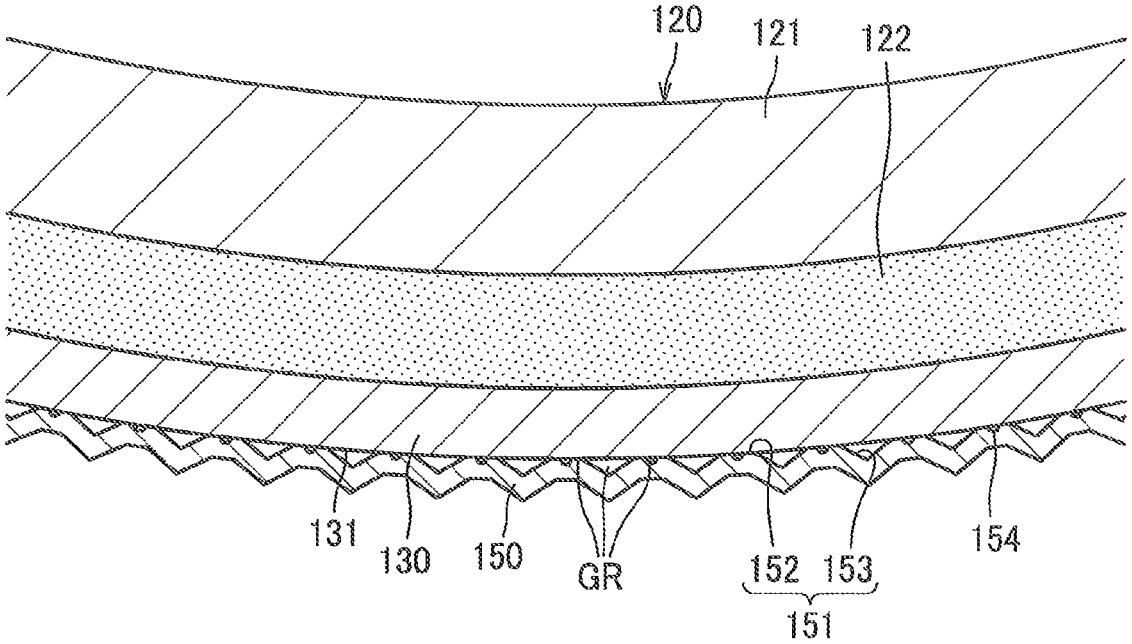
FIG. 3 is an enlarged view illustrating a part of an endless belt and a sliding sheet in FIG. 2.
Figure 4:
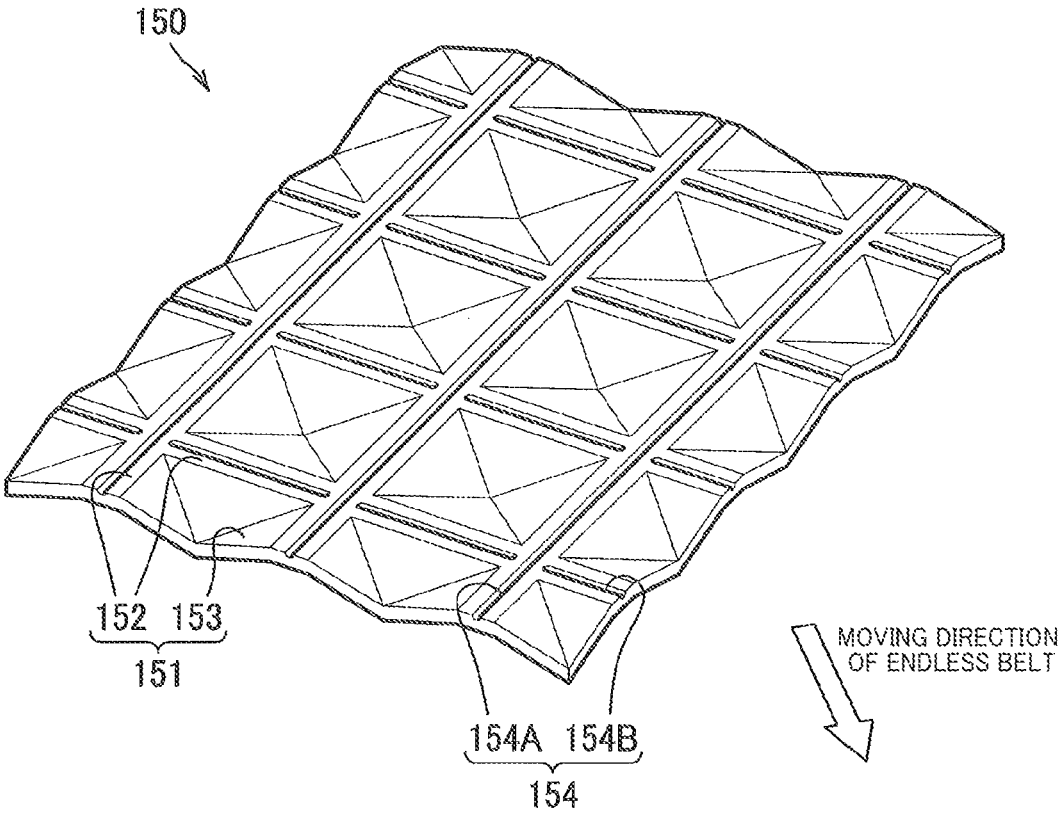
FIG. 4 is an enlarged perspective view illustrating an opposed surface of the sliding sheet.

As illustrated in FIG. 3, the sliding sheet 150 has a opposed surface 151 that is opposed to the inner circumferential surface 131 of the endless belt 130. As illustrated in FIG. 4, the opposed surface 151 is formed in an uneven shape in which at least one of sides of each of a plurality of polygons becomes a ridge. In the embodiment, the opposed surface 151 is formed in the uneven shape in which sides of a plurality of squares become ridges. The opposed surface 151 includes a contact portion 152 contacting the endless belt 130 and a plurality of recessed portions 153 not contacting the endless belt 130.

A ratio of an area of the contact portion 152 in the opposed surface 151 of a predetermined area is 50% or less. The contact portion 152 is located in sides of the plurality of squares formed in the opposed surface 151. The contact portion 152 obliquely extends with respect to a rotation direction of the endless belt 130, namely, the moving direction. In the contact portion 152, grooves 154 extending along a direction in which the contact portion 152 extends are formed.

Each of the grooves 154 obliquely extends with respect to the moving direction of the endless belt 130. A depth of each of the grooves 154 is 0.1 to 0.005 times of a depth of each of the recessed portions 153. The grooves 154 include first grooves 154A and second grooves 154B.

Figure 5:
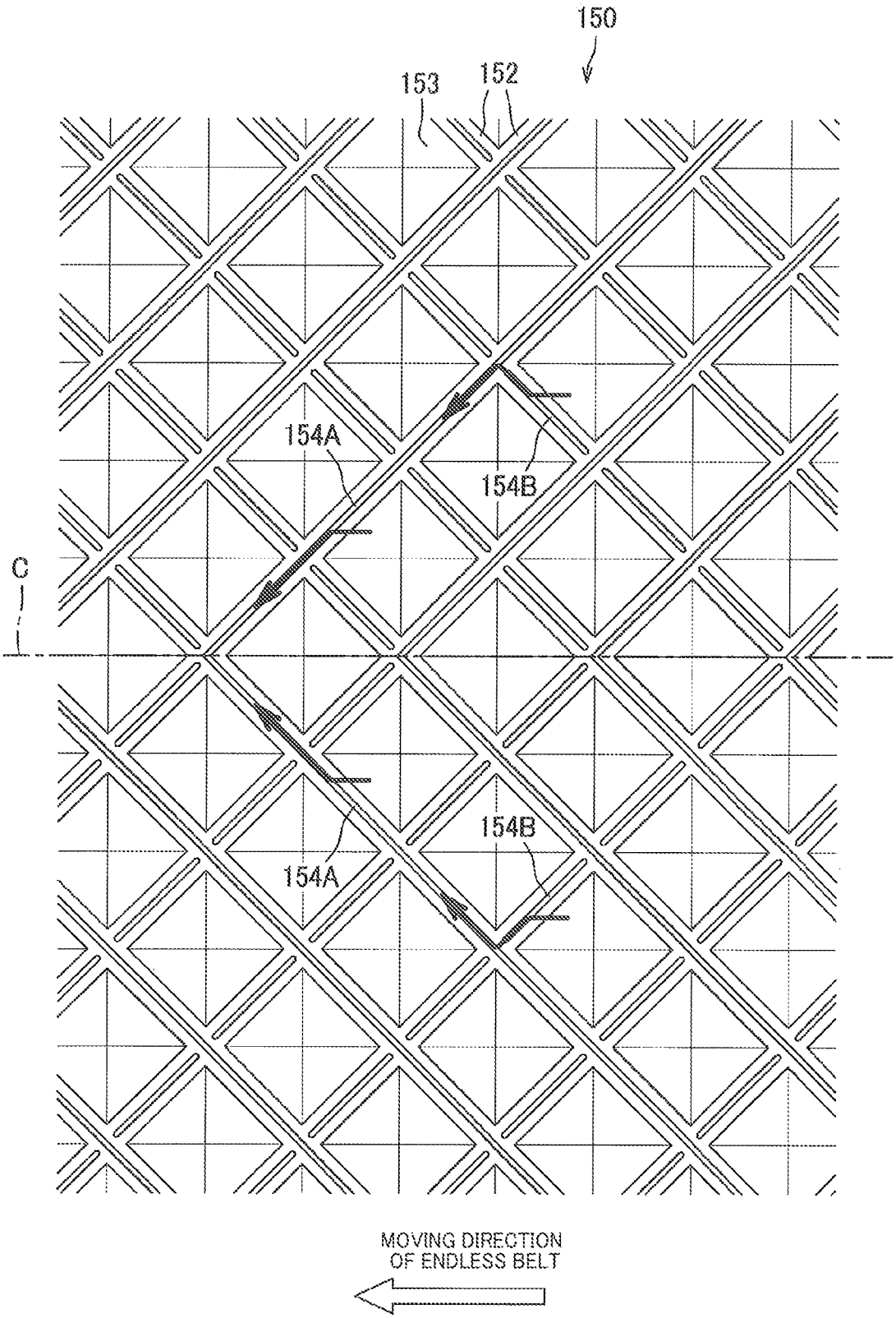
FIG. 5 is a plan view of the opposed surface of the sliding sheet.

As illustrated in FIG. 5, each of the first grooves 154A extends in a direction getting closer to a center C of the sliding sheet 150 in the width direction of the sliding sheet 150 as going toward a downstream side of the sliding sheet 150 in the moving direction of the endless belt 130. Each of the first grooves 154A continuously extends. Each of the second grooves 154B extends in a direction going away from the center C of the sliding sheet 150 in the width direction of the sliding sheet 150 as going toward the downstream side of the sliding sheet 150 in the moving direction of the endless belt 130. The second grooves 154B are separated by the first grooves 154A and extend intermittently.

The recessed portions 153 are portions recessed from the contact portion 152 in a direction apart from the endless belt 130. The recessed portions 153 are surrounded by the contact portion 152. Since the contact portion 152 is configured so as to form the plurality of squares as illustrated in FIG. 4, each of the recessed portions 153 has a square pyramid shape an apex of which is the bottom.

A base material of the endless belt 130 is made of a heat-resistant resin having the glass transition temperature of 140° C. or more. Heat-resistant resins with the glass transition temperature of 140° C. or more are, for example, polyimide (glass transition temperature 220° C.), polyether ether ketone (glass transition temperature 143° C.), polyether-imide (glass transition temperature 216° C.), and the like. In the embodiment, the endless belt 130 is made of polyimide. It is also preferable that the surface of the endless belt 130 is coated with fluorine resin or the like.

A microhardness of the endless belt 130 by nanoindentation technique is higher than a microhardness of the sliding sheet 150. The microhardness is measured in accordance with a method for ultra-low loaded hardness test specified by Japanese Industrial Standards JIS Z2255. The microhardness of the inner circumferential surface 131 of the endless belt 130 and the microhardness of the contact portion 152 on the opposed surface 151 of the sliding sheet 150 are measured. The microhardness may be measured by using a film material which is a material for the endless belt 130 and the sliding sheet 150.

A surface roughness Ra of the inner circumferential surface 131 of the endless belt 130 measured along the rotation direction of the endless belt 130 is smaller than a surface roughness Ra of the opposed surface 151 of the sliding sheet 150 opposed to the endless belt 130 measured along the rotation direction. The surface roughness Ra is measured in accordance with a method specified by Japanese Industrial Standards JIS B0601.

Returning to FIG. 2, the upstream belt guide 160 is a member guiding movement of the endless belt 130 in the upstream of the nip portion NP in the conveying direction of the sheet S. The upstream belt guide 160 has a curved surface such that the endless belt 130 can smoothly rotate.

The downstream belt guide 170 is a member guiding movement of the endless belt 130 in the downstream of the nip portion NP in the conveying direction of the sheet S. The downstream belt guide 170 has a curved surface such that the endless belt 130 can smoothly rotate.

The stay 180 is a member supporting the holder 140, the upstream belt guide 160, and the downstream belt guide 170. The stay 180 is formed by press-molding a metal plate.

The grease GR is provided between the endless belt 130 and the sliding sheet 150 for reducing friction between the endless belt 130 and the sliding sheet 150. The grease GR is located on the inner circumferential surface 131 of the endless belt 130, the contact portion 152, the recessed portion 153, and the grooves 154 in the sliding sheet 150.

The grease GR includes a base oil, a thickener, and an additive. The consistency of the grease GR is preferably 330 to 385 at 25° C. More preferably, the consistency of the grease GR is 335 to 350 at 25° C. A yield stress of the grease GR is 50 to 250 Pa.

The consistency and the yield stress of the grease GR can be adjusted according to a mixing radio of the base oil and the thickener.

The consistency is measured in accordance with a method specified by Japanese Industrial Standards JIS K2220. The consistency of the grease GR is obtained by dropping a cone attached to a consistency meter into a sample filled in a pot at 25° C. and by reading a depth of the cone after the cone has penetrated for 5 seconds (refer to 7. 1, JIS K2220).

The yield stress in the present application corresponds to a stress value obtained when a storage elastic modulus G' becomes equal to a loss elastic modulus G". The storage elastic modulus G' and the loss elastic modulus G" are measured by a rheometer (viscoelasticity measurement device) specified by Japanese Industrial Standards JIS K7244-10. In this case, a measurement frequency of the rheometer is set to 1 Hz.

As for the storage elastic modulus G' and the loss elastic modulus G", a distortion γ0, a phase difference δ, and a stress peak σ0 can be measured when a stress is measured while distortion is gradually increased.

The storage elastic modulus G' is obtained by dividing a peak value of an elastic body component by the peak value of distortion ($G'=\sigma 0\times \cos \delta \div \gamma 0$).

The loss elastic modulus G" is obtained by dividing a peak value of a viscous body component by the peak value of distortion ($G''=\sigma 0\times \sin \delta \div \gamma 0$).

The base oil is made of fluorine oil. The fluorine oil is, for example, perfluoropolyether (PFPE) or chlorotrifluoroethylene (CTFE). The base oil contains perfluoropolyether in the embodiment. A viscosity of the base oil in the embodiment is 100 to 400 $mm^2/S$ at 40° C.

The thickener is made of a solid lubricant containing fluorine. The solid lubricant containing fluorine is, for example, polytetrafluoroethylene (PTFE) in the embodiment.

The additive is a solid lubricant, with layered crystal, not containing fluorine. The layered solid lubricant not containing fluorine is, for example, melamine cyanurate (MCA), molybdenum disulfide, or graphite. In the embodiment, melamine cyanurate (MCA) is used as the solid lubricant. A particle size of melamine cyanurate is 10 to 20 times larger than a particle size of polytetrafluoroethylene (PTFE).

According to the above, the following advantages can be obtained in the embodiment. In the fixing device 8 according to the embodiment, the base materials of the endless belt 130 and the sliding sheet 150 are both made of the heat-resistant resin having the glass transition temperature of 140° C. or more. However, when the heat-resistant resin is increased in temperature close to the glass transition temperature, the heat-resistant resin is softened, and adhesive wear tends to occur. Accordingly, the fixing device 8 is configured such that the grease GR provided between the endless belt 130 and the sliding sheet 150 includes the base oil made of the fluorine oil and the thickener made of the solid lubricant containing fluorine and has the consistency of 330 to 385 at 25° C. When adopting the grease GR, an oil film made of the grease GR is formed between the endless belt 130 and the sliding sheet 150 to thereby suppress wear between the endless belt 130 and the sliding sheet 150 even in the high-temperature condition as a use state of the fixing device 8.

The endless belt 130 and the sliding sheet 150 are both made of polyimide with the high glass transition temperature; therefore, it is possible to use the fixing device 8 at a high fixing temperature. Moreover, even in a condition that adhesion tends to occur as the endless belt 130 and the sliding sheet 150 are made of the same kind of material, it is possible to suppress, by the grease GR, wear between the endless belt 130 and the sliding sheet 150.

Since the base oil of the grease GR contains perfluoropolyether, it is possible to suppress wear between the endless belt 130 and the sliding sheet 150.

Since the thickener of the grease GR contains polytetrafluoroethylene, it is possible to suppress wear between the endless belt 130 and the sliding sheet 150.

Since the grease GR further includes the solid lubricant with layered crystal not containing fluorine as the additive, it is possible to further suppress wear between the endless belt 130 and the sliding sheet 150.

Since the solid lubricant is melamine cyanurate, it is possible to suppress wear between the endless belt 130 and the sliding sheet 150.

The opposed surface 151 of the sliding sheet 150 has the contact portion 152 contacting the endless belt 130 and the plurality of recessed portion 153. Accordingly, the contact area between the endless belt 130 and the sliding sheet 150 can be reduced, and friction between the endless belt 130 and the sliding sheet 150 can be reduced. Moreover, the grease GR can be held in the recessed portions 153 of the sliding sheet 150; therefore, it is possible to further reduce friction between the sliding sheet 150 and the endless belt 130.

Since the recessed portions 153 of the sliding sheet 150 are surrounded by the contact portion 152, the grease GR can be easily held.

Furthermore, the sliding sheet 150 is formed in the uneven shape such that sides of a plurality of squares become ridges. Since the uneven shape of the sliding sheet 150 is simple, the sliding sheet 150 can be manufactured easily.

In the sliding sheet 150, the contact portion 152 obliquely extends with respect to the rotation direction of the endless belt 130. Accordingly, it is possible to suppress unevenness in nip pressure in the rotation direction generated when the endless belt 130 rotates.

Also in the sliding sheet 150, the grooves 154 extending in directions in which the contact portion 152 extends are formed. Accordingly, the grease GR can be held in the grooves 154; therefore, friction between the sliding sheet 150 and the endless belt 130 can be further reduced.

The grooves 154 include the first grooves 154A and the second grooves 154B. As illustrated in FIG. 5, each of the first grooves 154A extends in the direction getting closer to the center C of the sliding sheet 150 in the width direction of the sliding sheet 150 and continuously extends; therefore, when the endless belt 130 moves, the grease GR can be drawn to the center C of the sliding sheet 150 in the width direction of the sliding sheet 150 by the first grooves 154A (refer to arrows in FIG. 5). On the other hand, the second groove 154B are separated by the first grooves 154A; therefore, when the grease GR moving along the second grooves 154B to the downstream side in the moving direction reaches the first groove 154A, the grease GR easily moves along the first groove 154A toward the center C of the sliding sheet 150 in the width direction. Accordingly, the grease GR hardly moves to outer sides in the width direction.

The pressure pad P includes the first pressure pad P1 and the second pressure pad P2. Accordingly, a nip width can be secured long.

Since the second pressure pad P2 is harder than the first pressure pad P1, the range pressed by the softer first pressure pad P1 can be secured long, and image quality such as gloss can be suitably adjusted by the harder second pressure pad P2.

The range not pressed by any of the first pressure pad P1 and the second pressure pad P2 (third nip portion NP3) in the nip portion NP is 20 to 50% of the entire range of the nip portion NP as illustrated in FIG. 2. Accordingly, there exists a space between the first pressure pad P1 and the second pressure pad P2, thereby securing the nip width long as well as reducing friction between the endless belt 130 and the sliding sheet 150 in the nip portion NP.

The range pressed by the second pressure pad 2 is 10 to 20% of the entire range of the nip portion NP. Accordingly, friction between the endless belt 130 and the sliding sheet 150 can be reduced by reducing the range pressed by the second pressure pad P2 which has the high pressing force.

As illustrated in FIG. 2, about half area of the endless belt 130 is in contact with the sliding sheet 150, while remaining about half area of the endless belt 130 is not in contact with the sliding belt 150. That is, the sliding sheet 150 constantly contacts the endless belt 130, however, each of a plurality of areas on the inner circumferential surface of the endless belt 130 repeats the state where each of the plurality of areas on the inner circumferential surface of the endless belt 130 is in contact with the sliding sheet 150 and the state where each of the plurality of areas on the inner circumferential surface of the endless belt 130 is not in contact with the sliding sheet 150 alternately. In such case, wear proceeds earlier in the endless belt 130 which slides intermittently than in the sliding sheet 150 which slides continuously.

The endless belt 130 and the sliding sheet 150 are both made of polyimide in the fixing device 8 according to the embodiment. The microhardness of the endless belt 130 by nanoindentation technique is higher than the microhardness of the sliding sheet 150; therefore, wear of the endless belt 130 can be suppressed. As a result, wear of the endless belt 130 proceeds in a well-balanced manner not earlier than the sliding sheet 150 more than necessary in the fixing device 8, which extends a lifetime of the fixing device 8.

The surface roughness Ra of the inner circumferential surface 131 of the endless belt 130 measured along the rotation direction of the endless belt 130 is smaller than the surface roughness Ra of the sliding sheet 150 measured along the rotation direction. Wear proceeds largely as the surface roughness Ra becomes higher; therefore, it is possible to suppress wear of the endless belt 130 and the sliding sheet 150 by reducing the surface roughness Ra of the endless belt 130 to be lower than the surface roughness Ra of the sliding sheet 150.

The grease GR disposed between the endless belt 130 and the sliding sheet 150 includes the base oil containing perfluoropolyether and polytetrafluoroethylene; therefore, it is possible to suppress wear of the endless belt 130 and the sliding sheet 150.

The grease GR further includes melamine cyanurate which is the solid lubricant with layered crystal not containing fluorine as the additive; therefore, it is possible to suppress wear of the endless belt 130 and the sliding sheet 150.

The present disclosure is not limited to the above embodiment, and can be used in various manners as illustrated as examples below.

The cylindrical roller including the heater 110 is illustrated as the rotating body in the embodiment; however, the present disclosure is not limited to this. For example, the rotating body may be an endless belt an inner circumferential surface of which is heated by the heater. It is also possible to adopt an external heating method in which the heater is disposed outside of the rotating body to heat the outer circumferential surface of the rotating body or an IH (Induction Heating) method. It is further possible to dispose the heater inside the endless belt to indirectly heat the rotating body contacting the outer circumferential surface of the endless belt. The rotating body and the endless belt may have heaters respectively.

The base material of the endless belt 130 and the base material of the sliding sheet 150 are both polyimide; however, the present disclosure is not limited to this. It is also preferable to adopt a configuration in which at least one of the base material of the endless belt and the base material of the sliding sheet is polyimide.

For example, a configuration in which the base material of the endless belt is made of polyimide and the base material of the sliding sheet is made of another heat-resistant resin may be adopted. A configuration in which the base material of the endless belt is made of another heat-resistant resin and the base material of the sliding sheet is made of polyimide may also be adopted.

It is also preferable to adopt a configuration in which neither of the base material of the endless belt 130 and the base material of the sliding sheet 150 is polyimide.

Figure 6A:
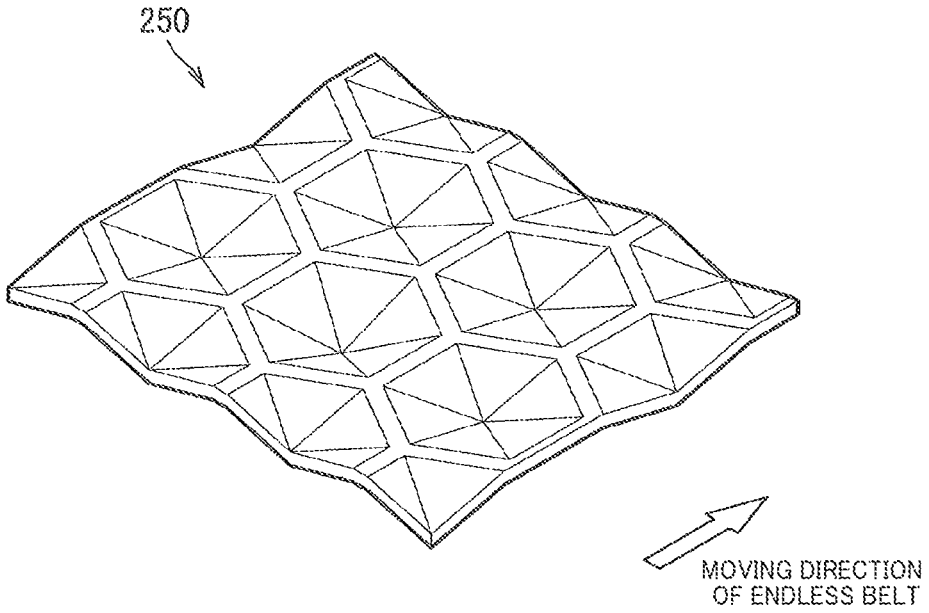
FIG. 6A is a perspective view illustrating another form of the sliding sheet.
Figure 6B:
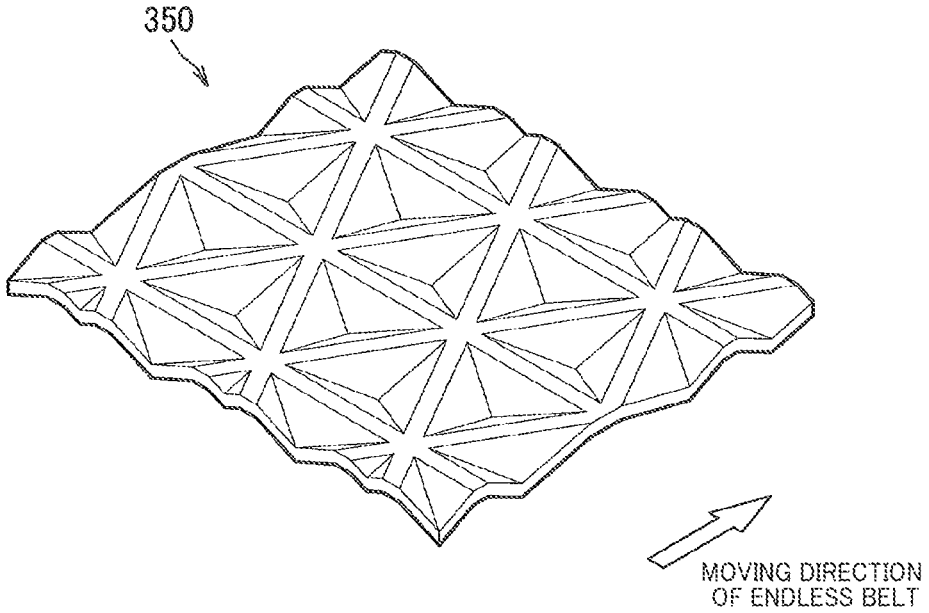
FIG. 6B is a perspective view illustrating another form of the sliding sheet.

The opposed surface 151 of the sliding sheet 150 is formed in the uneven shape such that sides of a plurality of squares make ridges in the embodiment; however, the present disclosure is not limited to this. Rectangles, parallelograms, and polygons other than squares may be used for the opposed surface 151. For example, an opposed surface of a sliding sheet 250 illustrated in FIG. 6A is formed in an uneven shape in which sides of a plurality of hexagons make ridges. Moreover, an opposed surface of a sliding sheet 350 illustrated in FIG. 6B is formed in an uneven shape in which sides of a plurality of triangles make ridges. The same advantages as the above embodiment can be obtained also by using the sliding sheets 250, 350. Though grooves formed in the contact portions are omitted in FIGS. 6A, 6B, the grooves may be formed in the same manner as the above embodiment.

In the embodiment, the first groove 154A and the second groove 154B are provided on the contacting portion 152 in the opposed surface 151, however, this discloser is not limited to this configuration. In a case where the plurality of recessed portion 153 are not provided in the opposed surface 151, the first groove 154A and the second groove 154B may be provided on the opposed surface 151.

Respective components explained in the above embodiment and modification examples may be arbitrarily combined to achieve the embodiment.

What is claimed is:

1. A fixing device, comprising:

a rotating body;

an endless belt contacting an outer circumferential surface of the rotating body, a base material of the endless belt being made of a heat-resistant resin having a glass transition temperature of 140° C. or more;

a heater configured to heat at least one of the rotating body and the endless belt;

a sliding sheet contacting an inner circumferential surface of the endless belt, a base material of the sliding sheet being made of a heat-resistant resin having a glass transition temperature of 140° C. or more;

a pressure pad, the endless belt and the sliding sheet being interposed between the pressure pad and the rotating body; and grease provided between the endless belt and the sliding sheet, wherein the grease includes a base oil made of a fluorine oil and a thickener made of a solid lubricant containing fluorine, and wherein the consistency of the grease is 330 to 385 at 25° C.

2. The fixing device according to claim 1, wherein at least one of the base material of the endless belt and the base material of the sliding sheet is polyimide.

3. The fixing device according to claim 1, wherein the base material of each of the endless belt and the base material of the sliding sheet is polyimide.

4. The fixing device according to claim 1, wherein the base oil contains perfluoropolyether.

5. The fixing device according to claim 1,
wherein the thickener contains polytetrafluoroethylene.
6. The fixing device according to claim 1,
wherein the grease further includes a solid lubricant with layered crystal not containing fluorine as an additive.
7. The fixing device according to claim 6,
wherein the solid lubricant is melamine cyanurate.
8. The fixing device according to claim 1,
wherein a yield stress of the grease is 50 to 250 Pa.
9. The fixing device according to claim 1,
wherein an opposed surface of the sliding sheet opposed to the inner circumferential surface of the endless belt includes a contact portion contacting the endless belt, and a plurality of recessed portions recessed from the contact portion and not contacting the endless belt.
10. The fixing device according to claim 9,
wherein a ratio of an area of the contact portion in the opposed surface is 50% or less.
11. The fixing device according to claim 9,
wherein the opposed surface is formed in an uneven shape in which at least one of sides of each of a plurality of polygons becomes a ridge,
wherein the contact portion is located in the at least one of sides of the plurality of polygons as the ridge, and
wherein the plurality of recessed portions are surrounded by the contact portion.
12. The fixing device according to claim 11,
wherein the plurality of polygons are squares.
13. The fixing device according to claim 9,
wherein the contact portion obliquely extends with respect to a rotation direction of the endless belt.
14. The fixing device according to claim 9,
wherein at least one groove extending along a direction in which the contact portion extends is formed in the contact portion.
15. The fixing device according to claim 14,
wherein a depth of the at least one groove is 0.1 to 0.005 times of a depth of the plurality of recessed portions.
16. The fixing device according to claim 1,
wherein a first groove and a second groove are provided on an opposed surface of the sliding sheet opposed to the inner circumferential surface of the endless belt, the first groove extending in a direction getting closer to a center of the sliding sheet in a width direction of the sliding sheet as going toward a downstream side of the sliding sheet in a direction in which the endless belt moves, the second groove extending in a direction going away from the center of the sliding sheet in the width direction of the sliding sheet as going toward the downstream side of the sliding sheet in the direction in which the endless belt moves.
17. The fixing device according to claim 1,
wherein the pressure pad includes a first pressure pad and a second pressure pad disposed downstream of the first pressure pad in a rotation direction in which the endless belt moves.
18. The fixing device according to claim 17,
wherein the second pressure pad has a higher durometer hardness than the first pressure pad.
19. The fixing device according to claim 17,
wherein the second pressure pad is located spaced apart from the first pressure pad, and
wherein a range not pressed by any of the first pressure pad and the second pressure pad in a nip portion where the rotating body is in contact with the endless belt is 20 to 50% of the entire range of the nip portion.
20. The fixing device according to claim 19,
wherein a range pressed by the second pressure pad is 10 to 20% of the entire range of the nip portion.

* * * * *